US006871630B2

(12) United States Patent
Herden et al.

(10) Patent No.: US 6,871,630 B2
(45) Date of Patent: Mar. 29, 2005

(54) COMBINED FUEL INJECTION VALVE/IGNITION PLUG

(75) Inventors: Werner Herden, Gerlingen (DE); Dieter Volz, Heilbronn (DE); Gernot Wuerfel, Vaihingen/Enz (DE); Anja Melsheimer, Stuttgart-Vaihingen (DE); Simon Schmittinger, Renningen (DE); Rainer Norgauer, Ludwigsburg (DE); Rene Deponte, Weil Im Schoenbuch (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/467,221

(22) PCT Filed: Sep. 20, 2002

(86) PCT No.: PCT/DE02/03551

§ 371 (c)(1),
(2), (4) Date: Dec. 16, 2003

(87) PCT Pub. No.: WO03/050409

PCT Pub. Date: Jun. 19, 2003

(65) Prior Publication Data

US 2004/0112328 A1 Jun. 17, 2004

(30) Foreign Application Priority Data

Dec. 6, 2001 (DE) ..... 101 59 909

(51) Int. Cl.[7] ..... F02M 57/06

(52) U.S. Cl. ..... 123/297; 123/267

(58) Field of Search ..... 123/266, 267, 123/297

(56) References Cited

U.S. PATENT DOCUMENTS

| | | | | | |
|---|---|---|---|---|---|
| 1,373,498 | A | * | 4/1921 | Gaff | 123/297 |
| 3,154,058 | A | | 10/1964 | Warren | 123/267 |
| 3,213,839 | A | * | 10/1965 | Gitlin et al. | 123/267 |
| 3,507,262 | A | | 4/1970 | Stage | 123/504 |
| 3,661,125 | A | | 5/1972 | Stumpfig | 123/255 |
| 4,006,725 | A | * | 2/1977 | Baczek et al. | 123/267 |
| 4,864,989 | A | * | 9/1989 | Markley | 123/267 |
| 5,186,132 | A | | 2/1993 | Runge | 123/169 R |
| 5,531,199 | A | * | 7/1996 | Bryant et al. | 123/297 |
| 5,983,855 | A | * | 11/1999 | Benedikt et al. | 123/297 |
| 6,595,182 | B2 | * | 7/2003 | Oprea et al. | 123/297 |

FOREIGN PATENT DOCUMENTS

| | | |
|---|---|---|
| DE | 69 521 204 | 6/2002 |
| EP | 0 661 446 | 7/1995 |
| GB | 2 311 327 | 9/1997 |
| JP | 57 000361 | 1/1982 |
| JP | 06-123 270 | 5/1994 |

* cited by examiner

*Primary Examiner*—Tony M. Argenbright
(74) *Attorney, Agent, or Firm*—Kenyon & Kenyon

(57) ABSTRACT

A fuel injector-spark plug combination comprises a fuel injector for the direct injection of fuel into a combustion chamber of an internal combustion engine and a spark plug with a spark-plug insulator, a first electrode and a second electrode for igniting the fuel injected into the combustion chamber. The fuel injector includes an actuator cooperating with an actuation device, which is in force-locking, operative connection to a valve needle, the valve needle, or a valve-closure member connected thereto, cooperating with a valve-seat surface to form a sealing seat. The valve needle of the fuel injector and the spark-plug insulator of the spark plug are positioned in a shared housing at a biaxial offset.

12 Claims, 2 Drawing Sheets

COMBINED FUEL INJECTION VALVE/IGNITION PLUG

FIELD OF THE INVENTION

The present invention is based on a fuel injector-spark plug combination.

BACKGROUND INFORMATION

From the European Published Patent Application No. 0 661 446, a fuel injector having an integrated spark plug is known. The fuel injector with integrated spark plug is used for the direct injection of fuel into the combustion chamber of an internal combustion engine and for igniting the fuel injected into the combustion chamber. Due to the compact integration of a fuel injector with a spark plug, it is possible to save installation space at the cylinder head of the internal combustion engine. The known fuel injector with integrated spark plug has a valve body which, together with a valve-closure member able to be actuated by means of a valve needle, forms a sealing seat, adjacent to which is a spray-discharge orifice, which discharges at an end face of the valve body facing the combustion chamber. A ceramic insulation element insulates the valve body from a housing body in a high-voltage proof manner, the housing body being able to be screwed into the cylinder head of the internal combustion engine. Located on the housing body is a ground electrode in order to form an opposite potential to the valve body acted upon by high voltage. In response to a sufficient high voltage being applied to the valve body, a spark arc-over occurs between the valve body and the ground electrode connected to the housing body.

However, a disadvantage of the known fuel injector with integrated spark plug is that the location of the spark arc-over is not defined with respect to the fuel jet spray-discharged from the discharge orifice, since the spark arc-over may occur at just about any point in the lateral region of a projection of the valve body. In this known design a reliable ignition of the so-called jet root of the fuel jet spray-discharged from the spray-discharge orifice is not possible with the required reliability. However, a reliable and temporally precisely defined ignition of the fuel jet is absolutely required to achieve reduced emissions. Furthermore, the discharge orifice of the fuel jet may be subject to continually worsening carbon fouling or coking, which influences the shape of the spray-discharged jet.

SUMMARY OF THE INVENTION

In contrast, the fuel injector-spark plug combination of the present invention has the advantage over the related art that by a biaxial arrangement of the valve needle of the fuel injector and the spark-plug insulator of the spark plug in a shared housing, which is insertable in the cylinder head of the internal combustion engine, the components are optimally arranged relative to each other, the system being easy to install and requiring little space.

In an advantageous manner, the spark-plug insulator is retained in its receiving bore by a threaded sleeve, a clamping ring or a fitting form of the plastic coating of the fuel injector. The spark-plug insulator is screwed into, or inserted in, the respective mounting support.

Particularly advantageous is the tilting of the longitudinal axis of the spark-plug insulator relative to the longitudinal axis of the valve needle, since it is prevents that the spark plug is directly exposed to the fuel jet of the fuel injector.

The fact that the spark location may be brought up closer to the nozzle (compared to the parallel axis arrangement), constitutes an additional advantage since it allows an unthrottled idling operation.

Moreover, it is advantageous that the spark plug and the ground electrode of the spark plug are each exchangeable independently of the fuel injector.

DETAILED DESCRIPTION

Figure 1:
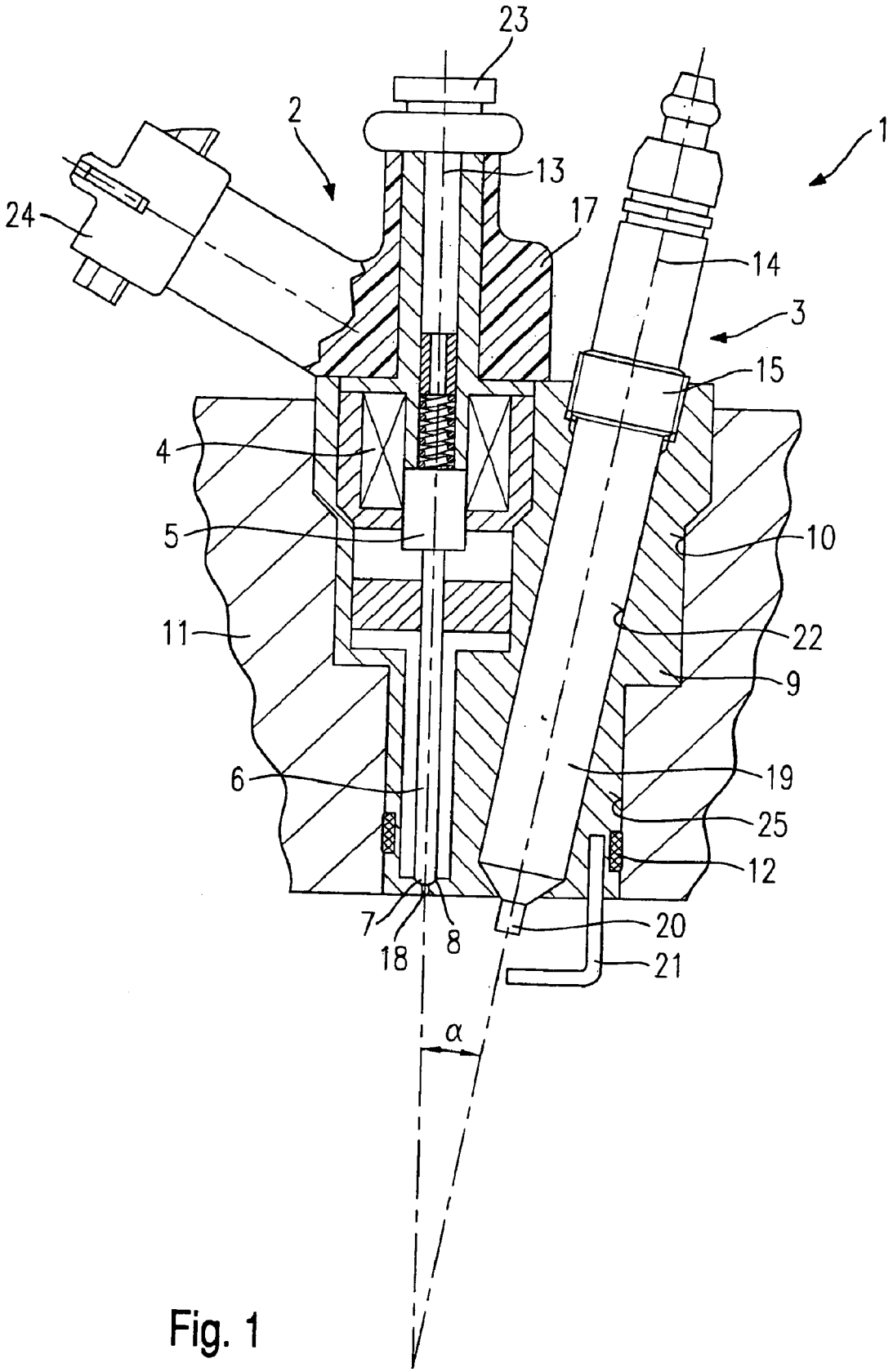
FIG. 1 shows a schematic section through a first exemplary embodiment of a fuel injector-spark plug combination configured according to the present invention.

FIG. 1 shows a fuel injector-spark plug combination 1 including a fuel injector 2 for the direct injection of fuel into a combustion chamber of a mixture-compressing internal combustion engine having external ignition, and having a spark plug 3 for igniting the fuel spray-discharged into the combustion chamber, according to a first exemplary embodiment of the present invention.

Fuel injector 2 has an actuator 4, which is embodied in the form of a solenoid coil in the present exemplary embodiment. Actuator 4 cooperates with an actuation device 5 for a valve needle 6, the actuation device being embodied as a solenoid armature 5 which cooperates with solenoid coil 4 in the present exemplary embodiment. At its downstream-side end, valve needle 6 has a valve-closure member 7, which cooperates with a valve-seat surface 8 to form a sealing seat. Fuel injector 2 has at least one spray-discharge orifice 18 through which fuel is spray-discharged into the combustion chamber of the internal combustion engine when fuel injector 2 is activated.

Fuel injector 2 may be surrounded, at least partially, by a plastic coating 17 which may be extruded onto a central fuel supply 23. Plastic coating 17 may also extend to an electric plug-in contact 24, which is used for the contacting of actuator 4.

Spark plug 3 has a conventional design and is made up of a spark-plug insulator 19, which is preferably made of a ceramic material, and a first electrode 20 guided therein. First electrode 20 is electrically contactable by an ignition device (not shown further). At least one second electrode 21 is formed on a housing 9, which connects fuel injector 2 and spark plug 3 according to the present invention.

Housing 9 is designed such that it forms a partial housing for fuel injector 2 and has a receiving bore 22 for spark-plug insulator 19 of spark plug 3. Spark-plug insulator 19 of spark plug 3 is connectable to housing 9 in a detachable manner. In the first exemplary embodiment shown in FIG. 1, spark-plug insulator 19 is screwed into a threaded sleeve 15, which is connected to housing 9 with positive engagement. Receiving bore 22 for spark-plug insulator 19 and valve needle 6 of fuel injector 2 are biaxially arranged and preferably tilted at an arbitrary angle $\alpha$, which is formed between a longitudinal axis 13 of valve needle 6 of fuel injector 2 and a longitudinal axis 14 of spark-plug insulator 19 of spark plug 3. Actuator 4 for actuating valve needle 6 is preferably integrated in housing 9 as well.

By a suitable selection of angle $\alpha$ and the geometry of the sealing seat and the at least one spray-discharge orifice 18 of fuel injector 2 and/or the injection jet, an optimal ignition of the mixture cloud injected into the combustion chamber is able to be ensured, spark plug 3 being subjected to minimal thermal shock, so that the fuel consumption and the emissions of the internal combustion engine are advantageously influenced.

The advantages of housing 9 configured according to the present invention over separate components are the ease of installation in a recess 10 of a cylinder head 11 of the internal combustion engine, the possibility of a separate exchange of spark-plug insulator 19 and second electrode 21 as well as the reduced installation space of spark plug 3 and fuel injector 2 in cylinder head 11.

The advantages compared to a coaxial positioning of fuel injector 2 and spark plug 3 are, in particular, the increased durability of the components and improved cold starting-characteristics of the internal combustion engine, since expensive ceramic coatings will not be necessary. This also keeps the manufacturing and servicing costs low. A further functioning advantage is the reduced susceptibility to failure due to greater hydraulic seal tightness.

Recess 10 of cylinder head 11 may be embodied in the form of a bore or an elongated hole, which is filled by the correspondingly formed housing 9. The sealing from the combustion chamber is accomplished by a seal 12, for example, which is located between housing 9 and a wall 25 of cylinder head 11. Seal 12 may have a toroidal or annular shape having any desired cross section and be made of a PTFE material, for instance. However, other sealing variants, such as plain washers, are also conceivable.

Figure 2:
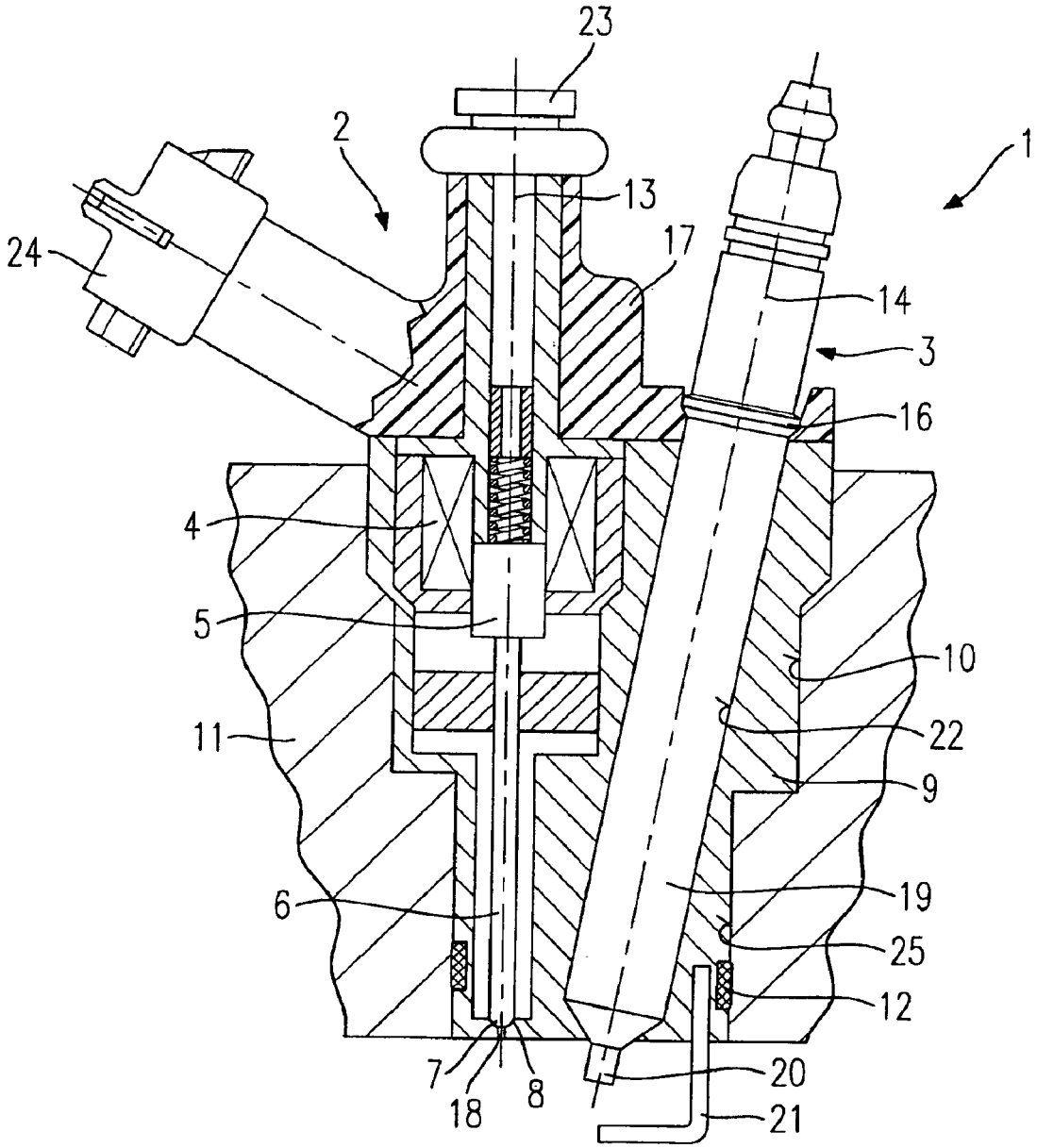
FIG. 2 shows a section through a second exemplary embodiment of a fuel injector-spark plug combination configured according to the present invention.

In the same view as FIG. 1, FIG. 2 shows a second exemplary embodiment of a fuel injector-spark plug combination 1 configured according to the present invention. Identical reference numerals are used for components that correspond to those in FIG. 1. Components already described in FIG. 1 will not be described anew.

The detachable affixation of spark-plug insulator 19 in housing 9, shown in the first exemplary embodiment in FIG. 1, in which spark-plug insulator 19 is screwed into a threaded sleeve 15, which is connected to the housing in a form-fitting manner, also may be accomplished in a different way. FIG. 2 shows a clamping ring 16, which is integrated in plastic coating 17 of fuel injector 2, for instance, this plastic coating having a widened design in the present second exemplary embodiment and extending, for example, across the entire radial extension of housing 9. Clamping ring 16 may also function in combination with the ignition coil (not shown further here), which is used for contacting spark plug 3, holding spark plug 3 in place in receiving bore 22, or else it may be omitted entirely in an appropriate dimensional design of receiving bore 22.

The present invention is not restricted to the exemplary embodiments shown and applicable to various designs of fuel injectors and arbitrary tilting angles of spark plug 3 and fuel injector 2 with respect to one another.

What is claimed is:

1. A fuel injector-spark plug combination, comprising:

a fuel injector for performing a direct injection of a fuel into a combustion chamber of an internal combustion engine, the fuel injector including:

a valve needle, a valve closure member, a valve seat surface, one of the valve needle and the valve closure member cooperating with the valve seat surface to form a sealing seat, an actuating device that is in a force-locking, operative connection to the valve needle, and an actuator that cooperates with the actuating device:

a spark plug including:

a spark-plug insulator, a first electrode, and a second electrode for igniting the fuel injected into the combustion chamber; and a shared housing, wherein the valve needle and the spark-plug insulator are positioned in the shared housing at a biaxial offset;

wherein the spark-plug insulator is detachably connected to the shared housing; and wherein the spark-plug insulator is screwed into the shared housing.

2. The fuel injector-spark plug combination as recited in claim 1, wherein:

the shared housing is able to be inserted in a recess of a cylinder head of the internal combustion engine.

3. The fuel injector-spark plug combination as recited in claim 2, further comprising:

a seal by which the shared housing is sealed from the cylinder head of the internal combustion engine.

4. The fuel injector-spark plug combination as recited in claim 1, wherein:

a longitudinal axis of the valve needle is tilted at an angle relative to a longitudinal axis of the spark-plug insulator.

5. The fuel injector-spark plug combination as recited in claim 1, wherein:

the fuel injector is integrated in the shared housing.

6. The fuel injector-spark plug combination as recited in claim 1, further comprising:

a threaded sleeve by which the spark-plug insulator is affixed in the shared housing.

7. A fuel injector-spark plug combination comprising:

a fuel injector for performing a direct injection of a fuel into a combustion chamber of an internal combustion engine, the fuel injector including:

a valve needle, a valve closure member, a valve seat surface, one of the valve needle and the valve closure member cooperating with the valve seat surface to form a sealing seat, an actuating device that is in a force-locking, operative connection to the valve needle, and an actuator that cooperates with the actuating device:

a spark-plug including:

a spark-plug insulator, a first electrode, and a second electrode for igniting the fuel injected into the combustion chamber:

a shared housing, wherein the valve needle and the spark-plug insulator are positioned in the shared housing at a biaxial offset, a clamping ring by which the spark-plug insulator is affixed on the shared housing, and a plastic coating provided to the fuel injector and in which the clamping ring is arranged in a form-fitting manner, wherein the spark-plug insulator is inserted in the shared housing, and wherein the spark-plug insulator is detachably connected to the shared housing.

8. The fuel injector-spark plug combination as recited in claim 7, wherein:

the spark-plug insulator is directly clipped into the plastic coating.

9. The fuel injector-spark plug combination as recited in claim 7, wherein:

the shared housing is able to be inserted in a recess of a cylinder head of the internal combustion engine.

10. The fuel injector-spark plug combination as recited in claim 9, further comprising:

a seal by which the shared housing is sealed from the cylinder head of the internal combustion engine.

11. The fuel injector-spark plug combination as recited in claim 7, wherein:

a longitudinal axis of the valve needle is tilted at an angle relative to a longitudinal axis of the spark-plug insulator.

12. The fuel injector-spark plug combination as recited in claim 7, wherein:

the fuel injector is integrated in the shared housing.

* * * * *